US008875461B2

(12) United States Patent
Kestermont

(10) Patent No.: US 8,875,461 B2
(45) Date of Patent: Nov. 4, 2014

(54) FOUNDATION WALL SYSTEM

(76) Inventor: Wesley F. Kestermont, Ebensburg, PA (US)

( * ) Notice: Subject to any disclaimer, the term of this patent is extended or adjusted under 35 U.S.C. 154(b) by 248 days.

(21) Appl. No.: 13/415,871

(22) Filed: Mar. 9, 2012

(65) Prior Publication Data

US 2013/0233164 A1 Sep. 12, 2013

(51) Int. Cl.
*E04B 2/70* (2006.01)

(52) U.S. Cl.
USPC ..... 52/404.1; 52/407.4; 52/407.3; 52/404.2; 52/293.3; 52/299; 52/236.6; 52/745.19

(58) Field of Classification Search
CPC ..... E04C 2/388; E04C 2/292; E04C 2/296; E04C 2/284; E04C 2/34; F41H 5/24; F41H 5/0485; F41H 5/04; F41H 5/02; E04H 15/18; E04B 2/70; E04B 1/36
USPC ..... 52/404.1, 407.3, 407.4, 404.2, 101, 52/299, 293.1, 236.6, 483.1, 481.1, 309.7, 52/293.3, 745.19; 89/36.04, 920
See application file for complete search history.

(56) References Cited

U.S. PATENT DOCUMENTS

| | | | | |
|---|---|---|---|---|
| 377,732 | A * | 2/1888 | Adams | 2/2.5 |
| 1,818,418 | A | 8/1931 | Millard | |
| 2,104,869 | A | 1/1938 | Levy | |
| 3,492,766 | A | 2/1970 | Andrews | |
| 3,657,849 | A | 4/1972 | Garton | |
| 4,061,819 | A | 12/1977 | Barnes | |
| 4,114,333 | A | 9/1978 | Jones et al. | |
| 4,147,004 | A | 4/1979 | Day et al. | |
| 4,471,591 | A | 9/1984 | Jamison | |
| 4,478,018 | A | 10/1984 | Holand | |
| 4,554,124 | A | 11/1985 | Sudrabin | |
| 4,628,650 | A * | 12/1986 | Parker | 52/265 |
| 5,072,559 | A | 12/1991 | Liljegren | |
| 5,505,031 | A | 4/1996 | Heydon | |
| 5,890,334 | A | 4/1999 | Hughes, Jr. | |
| 6,076,320 | A | 6/2000 | Butler | |
| 6,279,880 | B1 | 8/2001 | Hawks, Jr. | |
| 6,290,992 | B1 * | 9/2001 | Magnuson-Hawkins | 424/660 |
| 6,308,491 | B1 | 10/2001 | Porter | |
| 6,568,145 | B2 | 5/2003 | Bartel | |
| 6,698,157 | B1 | 3/2004 | Porter | |
| 7,066,529 | B2 | 6/2006 | Yurgevich et al. | |
| 7,533,599 | B2 * | 5/2009 | Mogensen | 89/36.04 |
| 7,625,827 | B2 | 12/2009 | Egan et al. | |
| 7,637,073 | B2 * | 12/2009 | Elliott et al. | 52/745.05 |
| 7,694,481 | B2 * | 4/2010 | Kestermont | 52/404.1 |

(Continued)

*Primary Examiner* — William Gilbert
*Assistant Examiner* — Beth Stephan
(74) *Attorney, Agent, or Firm* — The Webb Law Firm

(57) ABSTRACT

A foundation wall includes a frame having a front side and a back side. The frame further includes a plurality of vertical stud members having a first end and a second end, a top beam attached to the first end of the plurality of vertical stud members, and a bottom beam attached to the second end of the plurality of vertical stud members to define a plurality of cavities between adjoining vertical stud members. Rigid insulation is adapted for positioning in the plurality of cavities to become a load-bearing part of the frame. One or more structural sheets is affixed to the front side of the frame and to the back side of the frame. A waterproof bond is formed along an interface between edges of the one or more structural sheets and a periphery around the front side and the back side of the frame.

19 Claims, 6 Drawing Sheets

(56) References Cited

U.S. PATENT DOCUMENTS

| | | | | |
|---|---|---|---|---|
| 8,122,679 | B2 | 2/2012 | Tonyan et al. | |
| 8,298,967 | B2 | 10/2012 | Egan et al. | |
| 8,479,470 | B2 | 7/2013 | Commins et al. | |
| 8,484,921 | B2 | 7/2013 | Edkins | |
| 2001/0004820 | A1* | 6/2001 | Poliquin | 52/481.1 |
| 2004/0003564 | A1* | 1/2004 | Surowiecki | 52/481.1 |
| 2004/0049997 | A1* | 3/2004 | Wheeler | 52/204.2 |
| 2004/0177581 | A1* | 9/2004 | Starke | 52/481.1 |
| 2005/0086905 | A1* | 4/2005 | Ralph et al. | 52/782.1 |
| 2006/0174572 | A1* | 8/2006 | Tonyan et al. | 52/481.2 |
| 2011/0023759 | A1* | 2/2011 | Waller | 109/79 |

* cited by examiner

FOUNDATION WALL SYSTEM

BACKGROUND OF THE INVENTION

1. Field of the Invention

The present invention relates generally to the fields of residential and commercial construction. More specifically, the invention pertains to the construction of pre-formed structural walls which may be positioned above or below ground level in a variety of construction applications where increased structural strength for extreme weather conditions and improved resistance to fire, insects, mold, and moisture is desired.

2. Description of the Related Art

For decades, the technology relating to structural walls in residential and commercial construction has seen little progress. The predominant method for constructing the conventional structural walls, foundation walls in particular, has been to pour the concrete footer and to use cinder blocks to build the foundation wall. More recently, a foundation wall molding method has gained acceptance where mold forms are assembled and concrete is poured into a void between the mold forms to create a solid concrete foundation wall.

While both of these construction methods produce structurally sound foundation walls, there are a number of disadvantages associated with using these conventional construction methods. Cinder blocks and concrete are expensive to produce and require a significant outlay of labor in order to construct a foundation wall of conventional construction. This increases the complexity of the construction and increases the cost of the building constructed using these conventional methods. Walls constructed using these materials cannot be pre-assembled and shipped to the job site. Additionally, conventional cinder blocks or concrete walls have poor insulation characteristics and can often lead to mold and mildew problems. Furthermore, these walls often allow water and radon to freely pass through the wall.

Within the prior art, there have not been many efforts to improve upon the conventional construction techniques and create a structural foundation wall that overcomes the shortcomings of concrete walls but retains their structural strength and long-term durability. While certain attempts have been made to create facings walls, such as the assembly disclosed in U.S. Application Publication No. 2004/0182031 to Fay et al., these solutions are merely aesthetic in nature and do not provide sufficient load-bearing capacity to serve as a building foundation. The wall disclosed in Fay et al. does not have the capability to withstand both normal forces and shear forces of the magnitude encountered by a building foundation structure. Accordingly, there has been a continuing need in the art for a foundation wall system which can be produced and installed efficiently, with improved insulation characteristics, increased overall strength, and long-term durability.

One solution has been proposed in U.S. Pat. No. 7,694,481 to the present inventor. Within this patent, an engineered wall system for use in above ground or below ground applications uses structural fiberglass-reinforced plastic as an outside membrane to a frame constructed of zinc-borate treated timber strand studs and plates. Rigid foam insulation is placed in the voids between the studs and the inside wall is enclosed with conventional drywall panel. While this wall system overcomes the shortcomings of the prior art with respect to the load-bearing capacity, the open inside wall portion does not offer adequate protection against water damage occurring from inside the building structure.

An additional drawback of conventional foundation wall systems is that they lack the capability to protect the occupants and items stored within the building from bullets or shrapnel making contact with the outside wall. Because cinder blocks, fiberglass-reinforced plastic, and rigid foam insulation are generally not adequate in stopping a projectile from passing through the wall and entering the building, there is a need for a foundation wall system having bulletproof and/or shrapnel-proof characteristics.

SUMMARY OF THE INVENTION

As described in detail herein, a foundation wall system may include a frame having a front side and a back side. The frame may include a plurality of vertical stud members having a first end and a second end and one or more top beams attached to the first end of the plurality of vertical stud members and one or more bottom beams attached to the second end of the plurality of vertical stud members to define a plurality of cavities between adjoining vertical stud members. Rigid insulation may be adapted for positioning in the plurality of cavities between adjoining vertical stud members to become a load-bearing part of the frame. One or more first structural sheets may be affixed to one of the front side or the back side of the frame and one or more second structural sheets may be affixed to the other of the front side or the back side of the frame. An upper channel beam may be provided on top of the upper-most top beam. A waterproof bond may be formed along an interface between edges of the one or more first structural sheets and a periphery around the front side of the frame and between edges of the one or more second structural sheets and a periphery around the front side of the frame.

In accordance with one embodiment of the foundation wall system, the one or more first and second structural sheets may be fiberglass-reinforced plastic sheets. According to yet another embodiment of the foundation wall system, the one or more first structural sheets may be a fiberglass-reinforced plastic sheet and the one or more second structural sheets may be an armored panel. The armored panel is desirably bulletproof. In accordance with a further embodiment of the foundation wall system, the one or more first and second structural sheets may be armored panels.

According to a further embodiment of the foundation wall system, a center stud may be provided at an approximate midpoint of the frame in the longitudinal direction, wherein the center stud is different from the plurality of vertical stud elements. Each of the plurality of vertical stud elements may be a timber strand stud. Each of the plurality of vertical stud elements may have a center core made from a timber strand material encased in one or more layers of fiberglass-reinforced plastic material. Each of the plurality of vertical stud elements may have a 2"×8" depth/width measurement, while the center stud may have a 4"×8" depth/width measurement. A wiring chase may extend through one or more vertical stud members.

In accordance with another embodiment, a foundation wall system may have an opening defined through the foundation wall system, wherein the opening is sized to receive a door or window therein. The one or more of the first and second structural sheets may be affixed to one or both of the frame and the rigid insulation by an adhesive, such as a water-based adhesive. Alternatively, the one or more of the first and second structural sheets may be affixed to one or both of the frame and the rigid insulation by a plurality of fasteners.

Further details and advantages of the present invention will become apparent from the following detailed description read in conjunction with the drawings.

DETAILED DESCRIPTION OF THE INVENTION

Figure 1:
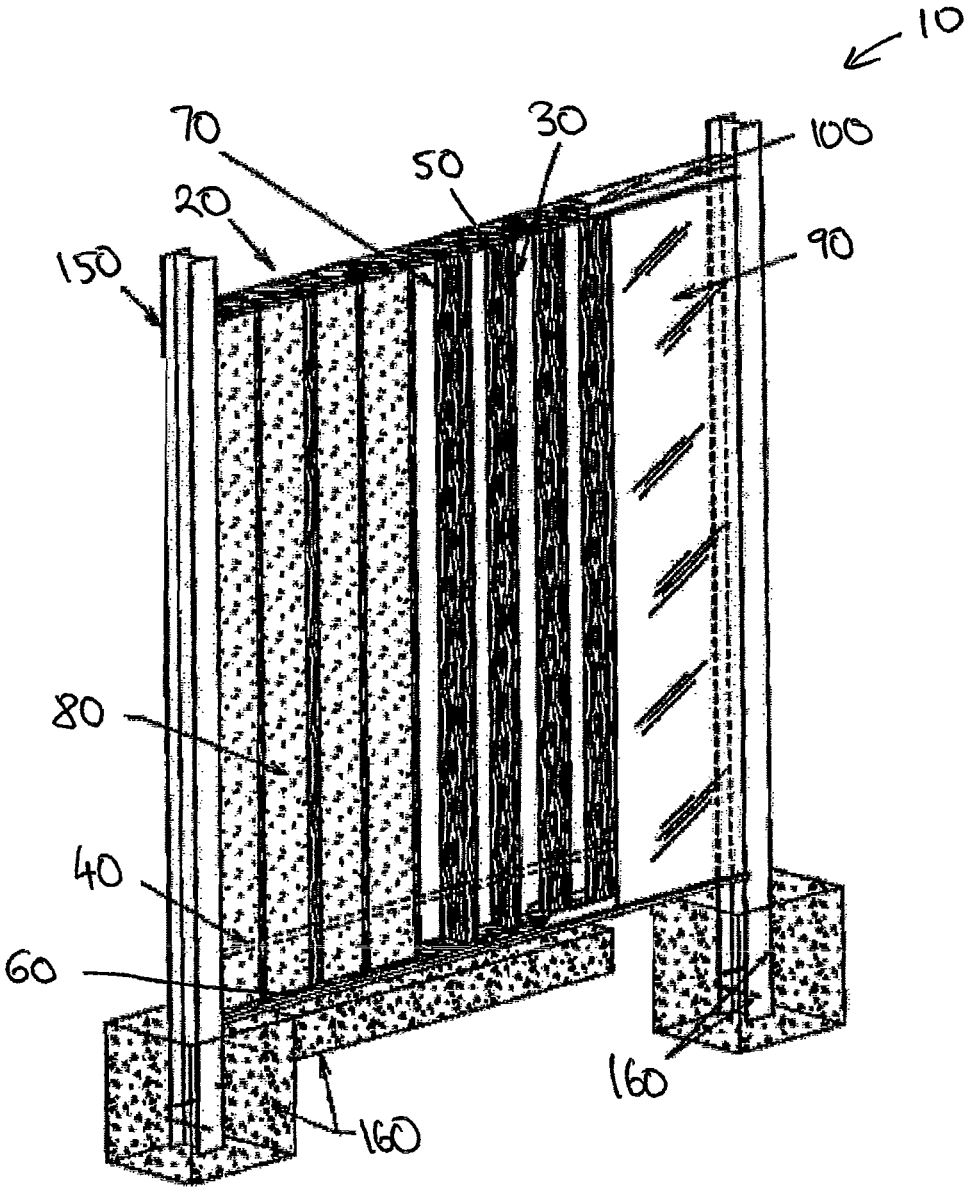
FIG. 1 shows a perspective view of one embodiment of a foundation wall system.

For purposes of the description hereinafter, spatial orientation terms, as used, shall relate to the referenced embodiment as it is oriented in the accompanying drawing figures or otherwise described in the following detailed description. However, it is to be understood that the embodiments described hereinafter may assume many alternative variations and configurations. It is also to be understood that the specific components, devices, and features illustrated in the accompanying drawing figures and described herein are simply exemplary and should not be considered as limiting.

Referring to the drawings in which like reference characters refer to like parts throughout the several views thereof, an embodiment of a foundation wall system 10 is shown and is generally described hereinafter for use in constructing a foundation of a building. Unless expressly noted otherwise, various embodiments of the foundation wall system 10 may be referred to as "a wall system 10", "the wall system 10",or simply as "wall 10". While the present disclosure describes the use of foundation wall system 10 for installation at or above ground level, its use is equally applicable to situations where a foundation is constructed below ground level.

Figure 2:
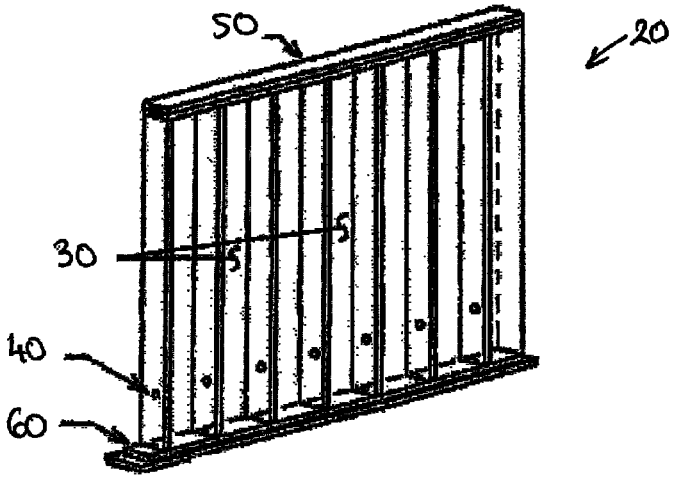
FIG. 2 shows a perspective view of a wall frame used with the foundation wall system illustrated in FIG. 1.

With reference to FIGS. 1 and 2, a single section of the foundation wall system 10 according to one embodiment of the present invention is illustrated. The wall system 10 includes a frame 20 constructed from a plurality of vertical stud members 30. Each vertical stud member 30 is separated from an adjacent stud member 30 by a predetermined distance, such as approximately 16" between the vertical stud member 30 centers. The vertical stud members 30 are generally rectangularly shaped, with the longer sides of the rectangle being arranged substantially parallel between adjacent vertical stud members 30. Each vertical stud member 30 optionally has a wiring chase 40 extending therethrough such that a wiring passage is created between adjacent vertical stud members 30 for passing wiring therethrough. The vertical stud members 30 desirably have conventional dimensions well known in the construction industry. For example, a cross-sectional profile of each vertical stud member 30 may be dimensioned to correspond to the industry standard for 2"×4", 2"×6", 2"'8", 2"×10", or 2"×12" studs. One of ordinary skill in the art will understand that various other sizes of the vertical stud member 30 may be utilized.

The frame 20 further includes one or more top beams 50 and one or more bottom beams 60 provided along the top and bottom portions of the vertical stud members 30. The top beam 50 and the bottom beam 60 are desirably dimensioned to correspond in width to the width of the vertical stud members 30 in the cross-sectional plane. The top beam 50 and the bottom beam 60 are secured to each vertical stud member 30 by mechanical fasteners (not shown) or other fastening means known in the art. A completed frame 20 showing a single top beam 50 and a single bottom beam 60 is illustrated in FIG. 2. Additional top and bottom beams may be provided in a vertically-stacked arrangement for added strength of the wall 10.

In certain embodiments, frame 20 includes a center stud 70 provided at an approximate longitudinal midpoint of the frame 20. The center stud 70 has identical height to the vertical stud members 30 of the frame 20. However, the center stud 70 desirably has a larger profile to provide increased strength and load-bearing capacity of the frame 20 at its longitudinal midpoint. For example, in one non-limiting embodiment, vertical stud members 30 have a 2"×8" profile And the center stud 70 has a 4"×8" profile.

The vertical stud members 30, the center stud 70, the top beam 50, and/or the bottom beam 60 desirably take the form of a timber strand stud. This is a specific type of stud that has increased load-bearing capacity and resistance to environmental damage compared to conventional studs. Unlike a traditional, saw-cut wooden stud that has a unitary construction, a timber strand stud is engineered lumber having a plurality of wood strands (poly strand material) of one or more types of wood glued together, compressed, and treated with anti-weathering and pest-resistance chemicals (e.g., zinc borate). In use, timber strand studs offer predictable strength and resistance to environmental damage compared to their conventional saw-cut wooden counterparts.

Figure 6A:
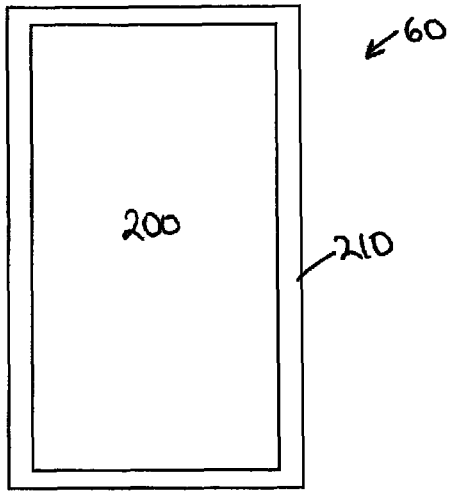
FIGS. 6A and 6B show cross-sectional views of a vertical stud member in accordance with various embodiments.
Figure 6B:
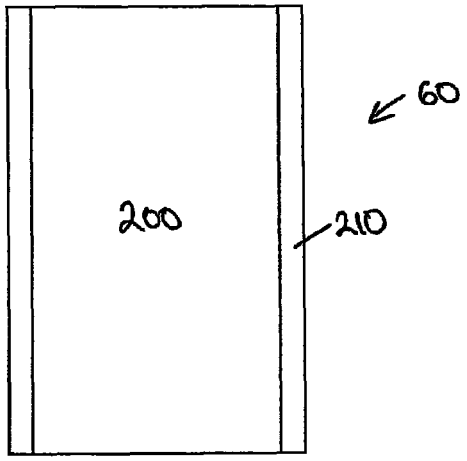

In alternate embodiments illustrated in FIGS. 6A and 6B, vertical stud members 30, the center stud 70, the top beam 50, and/or the bottom beam 60 have the form of a fiberglass-reinforced plastic (FRP) timber strand stud. While the following description of the embodiment illustrated in FIGS. 6A and 6B is made with reference to a vertical stud member 60, one of ordinary skill in the art will appreciate that the center stud 70, the top beam 50, and/or the bottom beam 60 can be manufactured in a similar manner. In the embodiment shown in FIG. 6A, vertical stud member 60 includes a center core 200 made from a timber strand material encased in a layer 210 of FRP material. The layer 210 desirably extends around the entire outer perimeter of the center core 200. A plurality of layers 210 may be added to strengthen the vertical stud member 60. Alternatively, as shown in FIG. 6B, FRP material can be added only on one or more sides of the center core 200. Adding the FRP material to the exterior of the center core 200 increases the loading strength of the vertical stud member 60. Additionally, the layer 210 of FRP material adds an additional measure of protection to the center core 200 from damage by water, insects, and/or mold.

With continuing reference to FIGS. 1 and 2, rigid insulation 80 is fitted between the vertical stud members 30 of the frame 20. The rigid insulation 80 is dimensioned to fit within each cavity formed between adjacent vertical stud members 30, top beam 50, and bottom beam 60. The rigid insulation 80 thus becomes a part of the frame structure and contributes to the load-bearing capacity of the frame 20. In one non-limiting embodiment, the rigid insulation 80 may be constructed from expandable polystyrene foam material having an R-value of 30. One of ordinary skill in the art will understand that various other forms of rigid insulation may be amenable for use in the wall system 10. Because the rigid insulation 80 is a structural part of the wall system 10, conventional fibrous insulation which is generally attached to a backing paper is not suitable for use in the wall system 10. This conventional insulation cannot be considered to be a suitable substitute for the rigid insulation 80 due to its fibrous properties.

Figure 3:
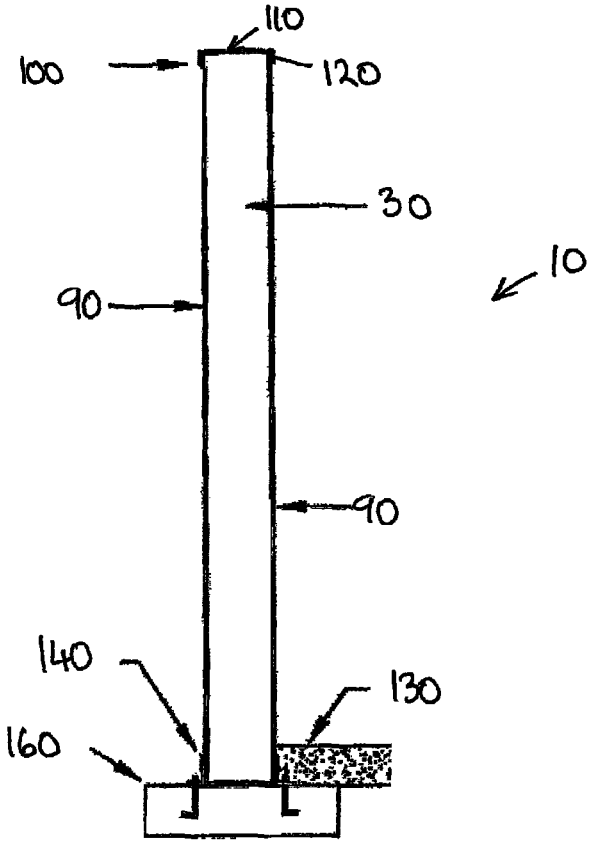
FIG. 3 shows a side view of the foundation wall system illustrated in FIG. 1.

With reference to FIGS. 1 and 3, front and back sides of the frame 20 are covered with sheet 90 which covers substantially all of the surface area on the front and back sides of the frame 20. One sheet 90 is desirably affixed to each of the front and back sides of the frame 20 and/or the rigid insulation 80 using a waterproof adhesive (not shown). The sheet 90 generally does not provide any load-bearing function to the wall system 10, but serves as a thermal barrier.

The sheet 90 may be constructed using a plurality of materials. In the embodiment shown in FIG. 3, sheet 90 which is applied on a side of the frame 20 which faces the exterior of a building may be a ¼" fiberglass-reinforced plastic material. Similar material may be applied on a side of the frame 20 which faces the interior of the building. Alternatively, sheet 90 used on this side may have increased thermal and/or fire protection properties in compliance with American Society of Testing and Materials (ASTM) standards. For example, for sheet 90 used on the side of the frame 20 which faces the interior of the building, the fiberglass-reinforced plastic material may have a flame spread value of approximately 15 and a smoke development value of approximately 80.

With continuing reference to FIGS. 1 and 3, wall system 10 includes an upper channel beam 100 which is placed on the top beam 50. The upper channel beam 100 is desirably manufactured from a high-strength and lightweight material, such as fiberglass-reinforced plastic (FRP). As shown in detail in FIG. 3, the upper channel beam 100 includes a top portion 110 and two side portions 120 extending from the sides of the top portion 110. The upper channel beam 100 is dimensioned such that the top portion 110 extends across the width of the top beam 50 and the side portions 120 extend along the sides of the top beam 50 in a downward direction. The sheet 90 provided on the front and back sides of the frame 20 extends into the space created between the frame 20 and each of the side portions 120. A plurality of upper channel beans 100 may be stacked for a higher load capacity.

The wall system 10 creates a modular construction which can be easily assembled offsite and delivered to the construction site in a finished state. In use, one or more wall systems 10 may be aligned in a desired manner to create the foundation wall of a building. For example, a plurality of wall systems 10 may be aligned to form a continuous wall section that extends in a linear direction. Alternatively, a plurality of wall systems 10 may be aligned to make a corner connection. The wall system 10 is desirably installed on a level footing surface 130 which constitutes the foundation of the building. The wall system 10 is desirably bolted, or otherwise secured, to the concrete footing surface 130. As shown in FIG. 3, the wall system 10 may be secured to the footing surface 130 by being bolted to an angle bracket 140. The footing surface 130 is desirably made from concrete.

In an alternate embodiment, the frame 20 may be positioned between a pair of beam columns 150 having an H-shaped cross section to retain the frame within a space provided on the beam columns 150. A bottom portion of each beam column 150 is cast within a footer 160. The beam columns 150 are spaced apart such that wall system 10 may be inserted between the beam columns 150 by lowering the wall system 10 between them. A part of the footer 160 may extend across the bottom of the frame 20. In this manner, a modular wall system 10 is created which can be assembled offsite and transported to the construction site. A wall system 10 with a built-in footer 160 eliminates the need for pouring a concrete footer on the construction site before the wall system 10 can be assembled.

Figure 4:
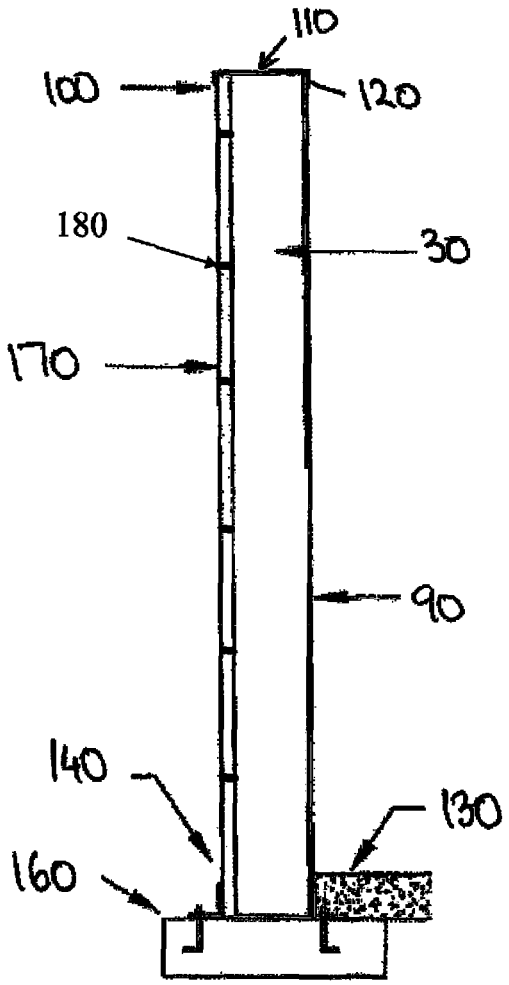
FIG. 4 shows a side view of the foundation wall system in accordance with a second embodiment of a foundation wall system.

With reference to FIG. 4, an alternate embodiment of the wall system 10 is illustrated. In this embodiment, one or more armored panels 170 are substituted for one sheet 90. The armored panel 170 used in this embodiment is desirably designed to withstand penetration by bullets of various caliber and shrapnel hitting the panel. In some embodiments, the armored panel 170 may be constructed from a ballistic-grade fiberglass-reinforced plastic material or a fiberglass material. The armored panel 170 may be placed on either side of the frame 20. The user may install conventional drywall on top of the armored panel 170 for the purpose of concealing it.

With continuing reference to FIG. 4, the wall system 10 includes a sheet 90 applied to one side of the frame 20 and the armored panel 170 applied on the opposing side of the frame 20. While the sheet 90 may be adhered to the frame 20 in a manner described above, armored panel 170 is desirably bolted or otherwise secured to the frame 20 via a plurality of fasteners 180. Due to the increased weight of the armored panel 170 compared to the weight of sheet 90, the armored panel 170 desirably rests upon the surface of a footer or a similar structure capable of withstanding its load. As shown in FIG. 4, the armored panel 170 rests on the footing surface 113. Similar to the embodiment shown in FIG. 3, the wall system 10 shown in FIG. 4 includes an upper channel beam 100 which is placed on top of the frame 20. The upper channel beam 100 is desirably manufactured from a high-strength and lightweight material, such as fiberglass-reinforced plastic. The upper channel beam 100 is dimensioned such that the top portion 110 extends across the width of the top beam 50 and the side portions 120 extend along the sides of the top beam 50 in a downward direction. The sheet 90 provided on one side of the frame 20 extends into the space created between the frame 20 and the first side portion 120, while the armored sheet 170 extends into the space created between the frame 20 and the second side portion 120 of the upper channel beam 100.

Figure 5:
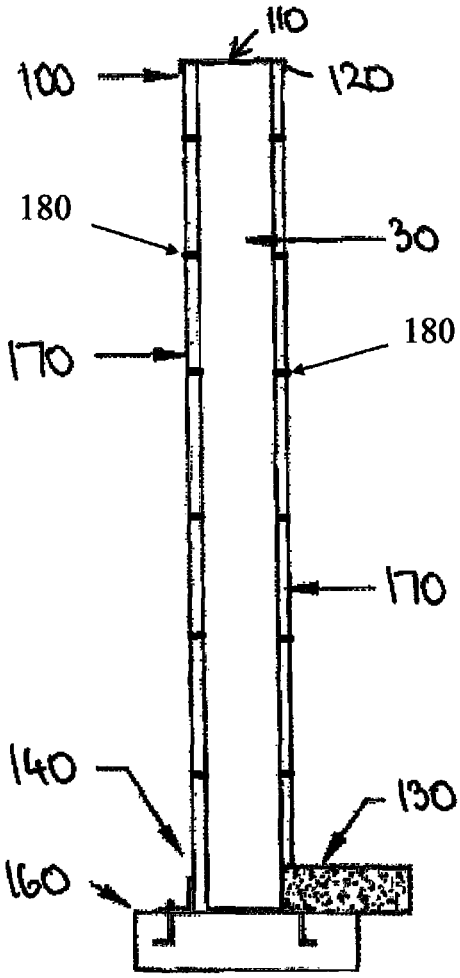
FIG. 5 shows a side view of the foundation wall system in accordance with a third embodiment of a foundation wall system.

With reference to FIG. 5, another alternate embodiment of the wall system 10 is illustrated. In this embodiment, one or more armored panels 170 are substituted for both sheets 90 provided on the front and back sides of the frame 20. Similar to the embodiment described above with reference to FIG. 4, the armored panel 170 used in the embodiment shown in FIG*s*. 6A-6B is desirably designed to withstand penetration by bullets of various caliber and shrapnel hitting the panel. The user may install conventional drywall on top of the armored panel 170 on one or both sides of the frame 20 for the purpose of concealing the armored panel 170.

With continuing reference to FIG. 5, the wall system 10 includes the armored panel 170 applied to one side of the frame 20 and the armored panel 170 applied on the opposing side of the frame 20. The armored panel 170 is desirably bolted or otherwise secured to the frame 20 via a plurality of fasteners 180. Due to the increased weight of the armored panel 170 compared to the weight of sheet 90 used in other embodiments, the armored panels 170 should desirably rest upon the surface of a footer or a similar structure capable of withstanding its load. As shown in FIG*s*. 6A-6B, the armored panel 170 rests on the footing surface 130. Similar to the embodiment shown in FIGS. 3 and 4, the wall system 10 shown in FIG. 5 includes an upper channel beam 100 which is placed on top of the frame 20. The upper channel beam 100 is desirably manufactured from a high-strength and lightweight material, such as fiberglass-reinforced plastic. The upper channel beam 100 is dimensioned such that the top portion 110 extends across the width of the top beam 50 and the side portions 120 extend along the sides of the top beam 50 in a downward direction. The armored panels 170 provided on both sides of the frame 20 extend into the space created between the frame 20 and the side portions 120 of the upper channel beam 100.

Having described the structure of various embodiments of the wall system 10, a method of assembling the wall system 10 will now be described. A frame 20 is constructed by aligning a plurality of vertical stud members 30 in a parallel arrangement in equally-spaced intervals and securing the vertical stud members to a top beam 50 and a bottom beam 60. In some embodiments, a plurality of mechanical fasteners may be used to secure the vertical stud members to a top beam 50 and a bottom beam 60. Each of the vertical stud members 30 may have a wiring chase 40 extending therethrough.

In the next step, the rigid insulation 80, usually in the form of sheets, is placed into each cavity formed between adjacent vertical stud members 30, top beam 50, and bottom beam 60. The rigid insulation 80 thus becomes a part of the frame structure and contributes to the load-bearing capacity of the frame 20.

In the following step, depending on the embodiment, a pair of sheets 90 are then affixed to the front and back sides of the frame 20 using a waterproof adhesive. In an embodiment shown in FIG. 4, one sheet 90 is affixed to one side of the frame 20 while an armored panel 170 is affixed to the opposing side of the frame 20 using a plurality of fasteners 180. In the embodiments shown in FIGs. 6A-6B, armored panels 170 are secured to each side of the frame 20. Next, an upper channel beam 100 is secured to the top beam 50 to create a modular wall system 10. A plurality of individual wall systems 10 may be aligned to form a continuous foundation wall structure. In certain embodiments, wall system 10 includes the beam columns 150 which facilitate aligning the wall systems 10 to form a continuous foundation wall structure. Beam columns 150 may be designed to enable placing individual framed sections of the wall system 10 in a linear manner. Alternatively, beam columns 150 may be designed to enable placing an individual framed section of the wall system 10 to form a corner connection.

The invention claimed is:

1. A foundation wall system comprising:

(a) a frame having a front side and a back side, the frame comprising:

(i) a plurality of vertical stud members having a first end and a second end, wherein each of the plurality of vertical stud members has a center core made from a timber strand material encased in one or more layers of fiberglass-reinforced plastic material that surrounds at least a portion of the center core; and (ii) one or more top beams attached to the first end of the plurality of vertical stud members and one or more bottom beams attached to the second end of the plurality of vertical stud members to define a plurality of cavities between adjoining vertical stud members;

(b) a rigid insulation adapted for positioning in the plurality of cavities between adjoining vertical stud members to become a load-bearing part of the frame;

(c) one or more first structural sheets affixed to one of the front side or the back side of the frame and one or more second structural sheets affixed to the other of the front side or the back side of the frame; and (d) an upper channel beam provided on top of the one or more top beams, wherein a waterproof bond is formed along an interface between edges of the one or more first structural sheets and a periphery around the front side of the frame and between edges of the one or more second structural sheets and a periphery around the front side of the frame.

2. The foundation wall system of claim 1, wherein the one or more first and second structural sheets are fiberglass-reinforced plastic sheets.

3. The foundation wall system of claim 1, wherein the one or more first structural sheets is a fiberglass-reinforced plastic sheet and the one or more second structural sheets is an armored panel.

4. The foundation wall system of claim 3, wherein the armored panel is bulletproof.

5. The foundation wall system of claim 1, wherein the one or more first and second structural sheets is an armored panel.

6. The foundation wall system of claim 5, wherein the armored panels are bulletproof.

7. The foundation wall system of claim 1, further comprising a center stud provided at an approximate midpoint of the frame in the longitudinal direction, wherein the center stud is different from the plurality of vertical stud elements.

8. The foundation wall system of claim 1, wherein each of the plurality of vertical stud elements is a timber strand stud.

9. The foundation wall system of claim 1, further comprising a footer.

10. The foundation wall system of claim 1, wherein each of the plurality of vertical stud elements has a 2"×8" depth/width measurement.

11. The foundation wall system of claim 6, wherein the center stud has a 4"×8" depth/width measurement.

12. The foundation wall system of claim 1, wherein a wiring chase extends through one or more vertical stud members.

13. The foundation wall system of claim 1, further comprising an opening defined through the foundation wall system, wherein the opening is sized to receive a door or window therein.

14. The foundation wall system of claim 1, wherein the one or more of the first and second structural sheets is affixed to one or both of the frame and the rigid insulation by an adhesive.

15. The foundation wall system of claim 14, wherein the adhesive is water-proof.

16. The foundation wall system of claim 1, wherein the one or more of the first and second structural sheets is affixed to one or both of the frame and the rigid insulation by a plurality of fasteners.

17. A foundation wall comprising:

(a) a frame having a front side and a back side, the frame comprising:

(i) a plurality of vertical stud members having a first end and a second end, wherein each of the plurality of vertical stud members has a center core made from a timber strand material encased in one or more layers of fiberglass-reinforced plastic material that surrounds at least a portion of the center core; and (ii) one or more top beams attached to the first end of the plurality of vertical stud members and one or more bottom beams attached to the second end of the plurality of vertical stud members to define a plurality of cavities between adjoining vertical stud members;

(b) a rigid insulation adapted for positioning in the plurality of cavities between adjoining vertical stud members to become a load-bearing part of the frame;

(c) one or more structural sheets affixed to one of the front side or the back side of the frame;

(d) one or more bulletproof armored panels affixed to one of the front side or the back side of the frame; and (e) an upper channel beam provided on top of the one or more top beams, wherein a waterproof bond is formed along an interface between (1) edges of the one or more structural sheets and one or more bulletproof armored panels and (2) a periphery around the front side and the back side of the frame.

18. A foundation wall comprising:

(a) a frame having a front side and a back side, the frame comprising:

(i) a plurality of vertical stud members having a first end and a second end, wherein each of the plurality of vertical stud members has a center core made from a timber strand material encased in one or more layers of fiberglass-reinforced plastic material that surrounds at least a portion of the center core; and (ii) one or more top beams attached to the first end of the plurality of vertical stud members and one or more bottom beams attached to the second end of the plurality of vertical stud members to define a plurality of cavities between adjoining vertical stud members;

(b) a rigid insulation adapted for positioning in the plurality of cavities between adjoining vertical stud members to become a load-bearing part of the frame;

(c) one or more structural sheets affixed to the front side of the frame and to the back side of the frame; and (d) an upper channel beam provided on top of the one or more top beams, wherein a waterproof bond is formed along an interface between edges of the one or more structural sheets and a periphery around the front side and the back side of the frame.

19. The foundation wall system of claim 18, wherein the one or more first and second structural sheets is a bulletproof armored panel.

* * * * *